United States Patent [19]

Brooks

[11] 4,429,931

[45] Feb. 7, 1984

[54] CONTAINED FIRE HOSE

[76] Inventor: Robert Brooks, 2 Caldwell St., Weymouth, Mass. 02191

[21] Appl. No.: 314,700

[22] Filed: Oct. 26, 1981

[51] Int. Cl.[3] ..... A47B 77/02

[52] U.S. Cl. ..... 312/228; 312/229; 312/237; 312/245

[58] Field of Search ..... 312/206, 228, 237, 245, 312/229; 222/527, 538; 169/51; 248/91, 92, 93, 75

[56] References Cited

U.S. PATENT DOCUMENTS

| | | | |
|---|---|---|---|
| 699,656 | 5/1902 | Cliff | 248/91 |
| 927,624 | 7/1909 | Wirt | 248/91 |
| 933,947 | 9/1909 | Allen | 248/92 |
| 1,049,136 | 12/1912 | Noble | 248/93 |
| 3,054,212 | 9/1962 | Morris | 312/242 |
| 3,067,822 | 12/1962 | Hattenhauer | 312/242 X |
| 3,168,248 | 2/1965 | Winslow | 222/527 |
| 4,006,948 | 2/1977 | Kessinger | 312/242 |

*Primary Examiner*—James T. McCall
*Assistant Examiner*—Joseph Falk
*Attorney, Agent, or Firm*—Wolf, Greenfield & Sacks

[57] ABSTRACT

A container adapted to be secured to the wall of a bathroom vanity or in a comparable location in a house adjacent to a water supply source. A fire hose has one end connected within the container to plumbing couplings for the supply of water. The fire hose is mounted for easy removal by stringing it through a series of closed rings having diameters substantially greater than the diameter of the hose when filled with water. The hose is accordion folded with the rings positioned at successive loops along one side of the accordion fold. A rod extends through the successive rings and is pivotally supported at one end within the container so that the rod may be pivoted outwardly of the container and the hose pulled from the rod.

3 Claims, 4 Drawing Figures

1
2
3
4
5
6
7
8
11
12
14
16
17
18
20
26
29
30
32
33
35

CONTAINED FIRE HOSE

SUBJECT MATTER OF INVENTION

The present invention relates to a means for storing a fire hose within a building and, in particular, a fire hose adapted for home use in a bathroom, kitchen or the like.

BACKGROUND OF INVENTION

A variety of fire extinguishers have been designed for home use. Most of these fire extinguishers are portable and commonly use chemical materials for extinguishing fires. Few, if any, home devices have been specifically designed for use with a home water supply as a source of fire extinguishing material. While chemicals are commonly used because certain types of fires are better handled with chemical extinguishers than with water, there is nonetheless a need for fire extinguishers which use water as a fire extinguishing medium. One reason for the limited availibility of water-based fire extinguishing systems for home use is the difficulty in designing a cosmetically acceptable system. Since a fire extinguishing system that provides a continuous water supply requires a substantial length of fire hose, the storing of each hose also presents a logistic problem.

SUBJECT MATTER OF PRESENT INVENTION

It is an object of the present invention to provide a means and method of storing a length of fire hose in a bathroom or other room having a water supply source. a further object of the present invention is to provide a compactly arranged container with a fire hose adapted for easy hook-up to a water supply source. A further object of the present invention is to provide a container having a fire hose that may be easily removed from the container and easily replaced without the likelihood of tangling the hose. A further object of the present invention is to provide a fire hose assembly that may be secured within and form a part of a wall of a bathroom vanity with the container having a cosmetically acceptable exterior.

In the present invention there is provided a means for storing a fire hose comprising a container shaped to be mounted in a wall of a room or in some other structure such as a bathroom vanity. In the present invention an elongated horizontal hanger is pivotally supported within the container. A length of fire hose is connected at one end to a water supply adjacent to the container. The hose is threaded through a plurality of rings having a diameter greater than the diameter of the hose. The hose is accordion folded with the rings spaced at the loop of each accordion fold along one side. The rings are supported from the hanger in such a manner as to permit the hose to be pulled from the container as the rings are pulled off the hanger.

BRIEF DESCRIPTION OF DRAWINGS

The foregoing objects and advantages of the present invention will be more clearly understood when considered in conjunction with the accompanying drawings in which.

DETAILED DESCRIPTION OF INVENTION

Figure 1:
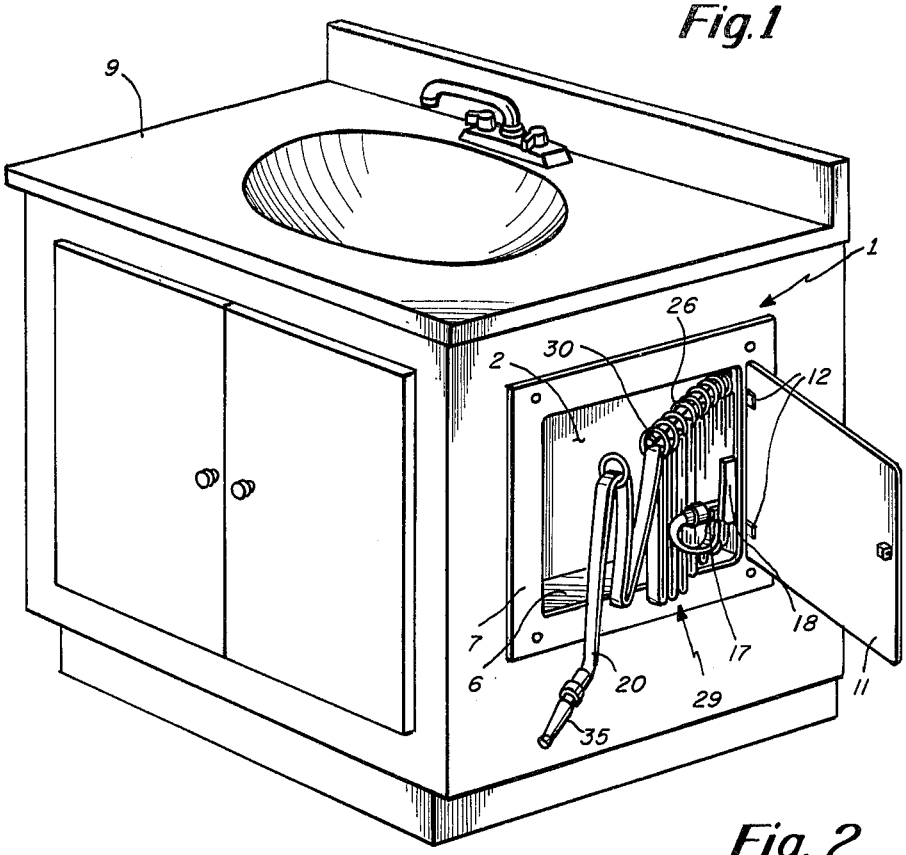
FIG. 1 is a perspective view of a bathroom vanity incorporating a countainer embodying a preferred form of the present invention.
Figure 2:
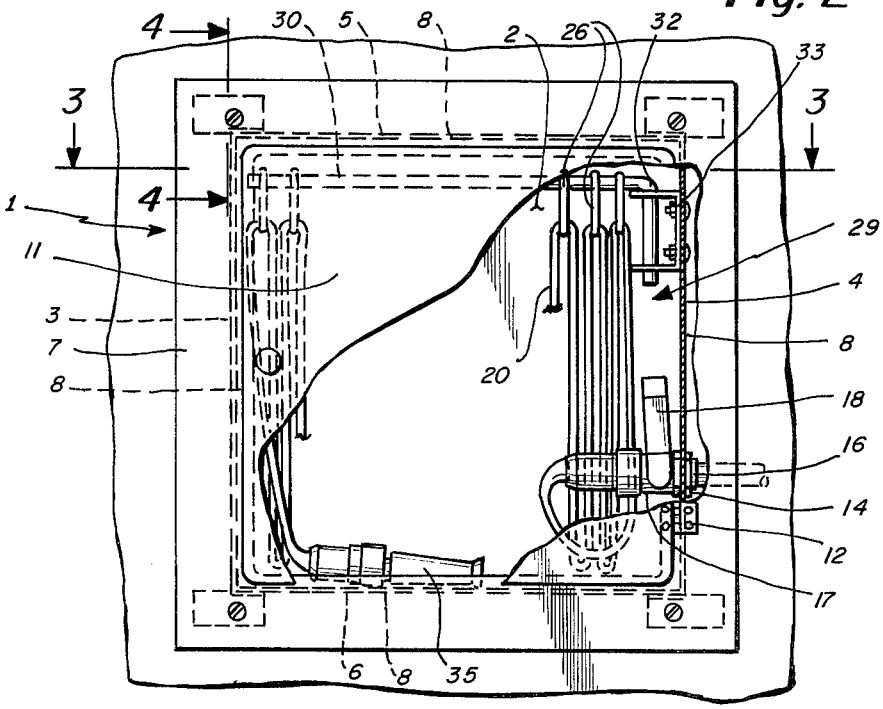
FIG. 2 is a partially fragmentary elevation of a container embodying a preferred form of the present invention.
Figures 3, 4:
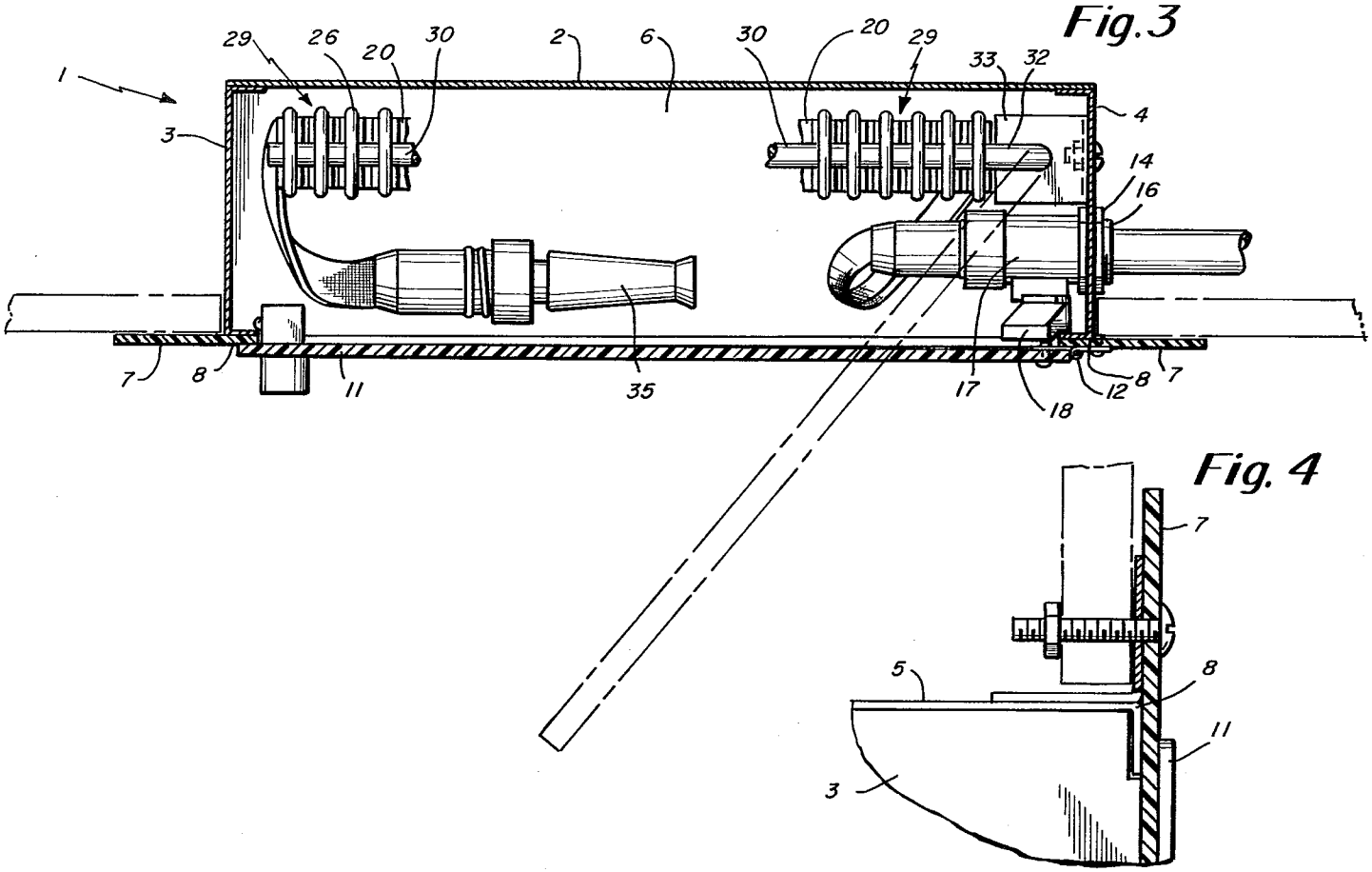
FIG. 3 is a cross-sectional detail along Line 3—3 of FIG. 1.
FIG. 4 is a cross-sectional detail along the Line 4—4 of FIG. 2.

Referring to the drawings, there is illustrated a container (1) comprising a rear wall (2), side walls (3) and (4) and top and bottom walls (5) and (6). Opposite the rear wall (2) a flange (7) extends outwardly from the edges (8) of the side walls (3) and (4) and top and bottom walls (5) and (6). The flange (7) is suitably secured to an opening formed within a bathroom vanity (9). The side opposite the rear wall (2) of the container is closed by a cover (11) hinged at (12).

While the preferred embodiment in this invention illustrates the container secured in a bathroom vanity beneath a sink, it should be understood that the invention contemplates securing this container in other locations as, for example, between the studs of a kitchen wall adjacent to a sink.

A coupling (14) is secured to the side wall (14) and is provided with a threaded end (16) adapted to be suitably connected by pipes to a water supply source by conventional plumbing means. Within the container, the coupling (14) is connected to a valve (17) having a handle (18) adapted to control the flow of water through the coupling (14) into a hose (20). One end of the hose (20) is connected to the valve (17). The hose, preferably about 50 feet in length, is preferably made of a fire-resistent material and has a diameter when filled with water of about one to one and one-half inches. The length of the hose is threaded through a plurality of rings. As shown in the preferred embodiment, approximately 20 rings may be threaded onto the hose. These rings (26) should have a diameter of about two inches and are preferably made of metal. The hose is accordion folded as illustrated at (29) with the rings (26) looped about each of the adjacent accordion folds. The rings are supported on an elongated hanger (30). This hanger is approximately 18 inches long and has one end bent into an "L" shaped configuration as illustrated at (32). The end (32) of the hanger (30) projects downwardly into aligned openings in the bracket (33). The bracker (33) in turn is screwed or otherwise suitably secured to the upper end of sidewall (4). The hanger (30) may pivot from a position parallel to the rear wall (2) outwardly through the open door in front of the container. When the hose is to be used the valve (17) is turned on and the free end (35) of the hose is pulled from the end of the hanger. This, in turn, causes the rings to slip from the ends of the hanger and the hose to unfold.

If desired, the lower end of groups of folds may be secured together by elastic bands. These hands will fall from the hose quite easily as the hose is pulled from the container.

From the foregoing description, those skilled in the art will appreciate that numerous variations may be made of this invention without departing from its spirit. Therefore, I do not intend to limit the scope of this invention to the embodiment shown and described. Rather, it is my intention that the scope of this invention be determined by the appended claims and their equivalents.

What is claimed is:

1. A means for storing a fire hose in a bathroom comprising in combination a bathroom vanity having a means providing a water supply, a container shaped and mounted on the wall of said bathroom vanity;

an elongated hangar;

means for pivotally supporting said hangar for movement from a position within said container to a position in which one end of the hanger extends out of said container;

a plurality of closed rings through which said hose extends with said hose folded in an accordion-like configuration and with said rings parallel to one another and engaging said hose at successive adjacent loops formed by said accordion-like folds;

said hanger extending through said successive rings supporting said hose whereby the hose may be pulled from the cabinet with successive segments of said hose defined by said rings being disengaged from said hanger as the rings are removed from said hanger and said means for providing a water supply including a pipe connected to one end of said hose and have a coupling for connecting to the water supply for said bathroom, a valve for controlling the flow of water through said pipe and means securing said pipe to said container.

2. A means for storing a fire hose as set forth in claim 1 wherin said means for pivotally supporting said hanger comprises an elongated bar, a bracket secured to an inner wall of said container, said bar pivotally engaging said bracket for arcuate movement in a horizontal plane.

3. A means for storing a fire hose as set forth in claim 2 wherein said container comprises a box-like enclosure having enclosing side walls and a door on one side through which access to said hose may be obtained, and a flange extending outwardly of the outer surface of said container for attachment to said vanity.

* * * * *